US008186921B2

(12) United States Patent
Lowman

(10) Patent No.: US 8,186,921 B2
(45) Date of Patent: May 29, 2012

(54) DRAIN PLUG

(75) Inventor: John David Lowman, New London, OH (US)

(73) Assignee: General Plug & Manufacturing Company, Grafton, OH (US)

( * ) Notice: Subject to any disclaimer, the term of this patent is extended or adjusted under 35 U.S.C. 154(b) by 585 days.

(21) Appl. No.: 11/608,377

(22) Filed: Dec. 8, 2006

(65) Prior Publication Data

US 2008/0135335 A1 Jun. 12, 2008

(51) Int. Cl.
*F16B 43/00* (2006.01)
*F16N 31/00* (2006.01)

(52) U.S. Cl. ..... 411/371.1; 411/383; 411/542; 184/1.5

(58) Field of Classification Search ..... 411/371.1, 411/369, 383, 542; 184/1.5
See application file for complete search history.

(56) References Cited

U.S. PATENT DOCUMENTS 239,111 A * 3/1881 O'Meara ..... 206/303
951,437 A * 3/1910 Gehrke ..... 220/304
2,343,235 A * 2/1944 Bashark ..... 285/220
2,752,814 A * 7/1956 Iaia ..... 411/542
4,146,207 A * 3/1979 Rofe ..... 251/120
4,810,148 A * 3/1989 Aisa et al. ..... 411/383
5,176,215 A * 1/1993 Ackerman ..... 184/1.5
5,269,336 A * 12/1993 Subramanian ..... 137/73
5,440,951 A * 8/1995 Okada et al. ..... 74/606 R
5,465,078 A 11/1995 Jones, Jr.
5,547,042 A * 8/1996 Platt ..... 184/1.5
5,579,815 A * 12/1996 Labonte ..... 141/384
5,634,755 A * 6/1997 Jones, Jr. ..... 411/383
5,971,189 A * 10/1999 Baughman ..... 220/288
6,078,238 A * 6/2000 Gerold ..... 335/305
6,347,708 B1 * 2/2002 Ostergaard ..... 209/326
6,726,048 B2 * 4/2004 Dwinell et al. ..... 220/257.2
6,979,162 B2 * 12/2005 Kato ..... 411/371.1
7,051,676 B1 * 5/2006 Deshaies ..... 119/75
7,318,390 B2 * 1/2008 Amy ..... 114/364
7,427,181 B2 * 9/2008 Denton et al. ..... 411/383
2006/0054402 A1 3/2006 Dorian

* cited by examiner

*Primary Examiner* — Flemming Saether
(74) *Attorney, Agent, or Firm* — Turocy & Watson, LLP

(57) ABSTRACT

Disclosed is a drain plug for an enclosure that contains a female-threaded opening. The drain plug contains a male-threaded portion and a head portion. The head portion contains a drive structure, an annular groove of substantially rectangular cross section, and a washer of substantially rectangular cross section in the groove. An outer wall of the annular groove is positioned to contact the enclosure when secured to the female-threaded opening.

17 Claims, 3 Drawing Sheets

DRAIN PLUG

TECHNICAL FIELD

The subject invention generally relates to drain plugs and methods of making and using drain plugs.

BACKGROUND

In an automotive engine, oil circulates between the engine, a reservoir and an oil pan. Oil is used to lubricate the engine to diminish the friction between a piston and a cylinder. A drain plug is used to seal openings in the oil pan of the engine. The oil pan generally has a tapped opening at the bottom to drain old oil from the oil pan. When removing the old oil from the oil pan, the drain plug is unscrewed to allow the old oil to drain through the tapped opening.

It is generally recommended that the engine oil of the automobile be changed every three thousand or so miles. Over a 100,000 mile span, this amounts to a maximum of about 33 oil changes. It is critical that the oil drain plug is screwed in the oil pan just right, i.e., not too tight and not too loose. If the oil drain plug is tightened too much, it may break. Also, if the oil drain plug is not screwed into the oil pan correctly, the oil pan thread may be damaged and cause oil to leak, potentially costing the automobile owner a lot of money for repairs.

SUMMARY

The following presents a simplified summary in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention relates to drain plugs for enclosures. The drain plug contains a male-threaded portion and a head portion. The head portion contains a drive structure, an annular groove of substantially rectangular cross section, and a washer of substantially rectangular cross section in the groove. An outer wall of the annular groove of the head is positioned to contact the enclosure when the drain plug is secured to a female-threaded opening of the enclosure. The washer of substantially rectangular cross section in the annular groove of substantially rectangular cross section prevents and/or mitigates leaks of contents of the enclosure. The contact between the outer wall of the annular groove of the head and the enclosure also prevents and/or mitigates leaks of contents of the enclosure. The subject invention also relates to methods of making and using drain plugs.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

The various aspects of the subject matter described herein are now described with reference to the annexed drawings, wherein like numerals refer to like or corresponding elements throughout. It should be understood, however, that the drawings and detailed description relating thereto are not intended to limit the claimed subject matter to the particular form disclosed. Rather, the intention is to cover all modifications, equivalents, and alternatives falling within the spirit and scope of the claimed subject matter.

Figure 1:
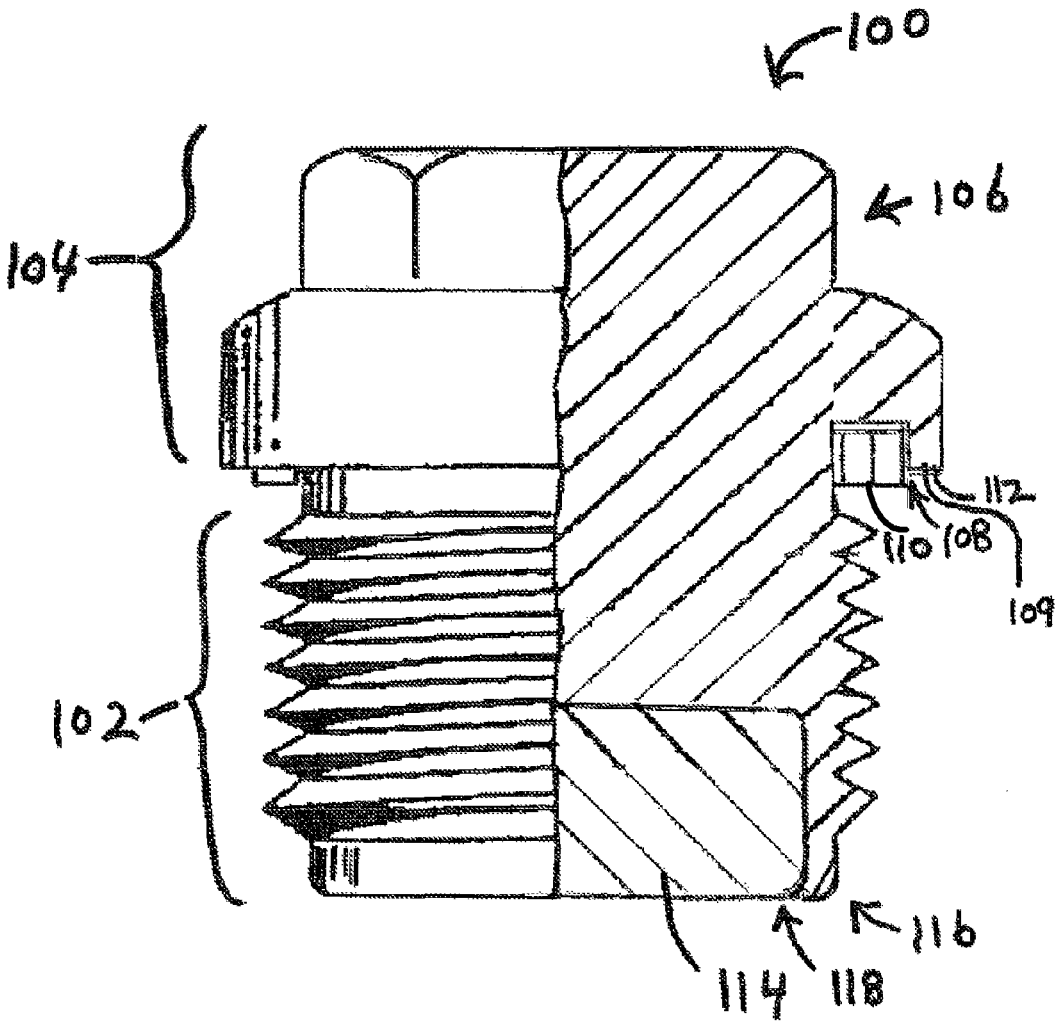
FIG. 1 illustrates a side view, partially cut away, of an exemplary drain plug in accordance with an aspect of the invention.

FIG. 1 illustrates an example of a drain plug 100 for an enclosure (not shown). The drain plug contains a male-threaded portion 102 and a head portion 104. The head portion 104 contains a drive structure 106, an annular groove 108 of substantially rectangular cross section, and a washer 110 of substantially rectangular cross section in the groove 108. The term "substantially rectangular" includes a rectangular shape and a square shape. For example, the annular groove 108 and/or the washer 110 have a rectangular cross section. In another example, the annular groove 108 and/or the washer 110 have a square cross section. The groove 108 is formed on the under-head surface 109 of the head portion 104 of the drain plug 100 adjacent the male-threaded portion and with an inner boundary having a diameter less than an outer diameter of the male-threaded portion.

The drain plug 100 can be used to close the access hole that is used to fill or drain substantially any suitable enclosure. The enclosure can contain a solid (e.g., fiber, powder, flake, particle, granule, pellet, and tablet), a liquid (e.g., water, oil, fuel, anti-freeze, air conditioning fluid, power steering fluid, and coolant), and a gas (e.g., LPG, air, compressed air, nitrogen, and carbon dioxide). For example, the drain plug 100 is used for an enclosure that is a portion of a transmission, transfer case, gearbox, transaxle, engine, differential and the like of an engine and/or machinery. Examples of the engines and machinery include automobiles, farm tractors, stationary machinery, portable machinery including generators, snowblowers, lawn mowers, small watercraft engines, and the like, construction vehicles and machinery such as diggers, front end loaders, trucks, cranes, fork lifts, pavers, graders, bulldozers and the like, boats, ships, helicopters, aircraft, trains, motorbikes, motorcycles, all-terrain vehicles, and related transportation machinery.

The drive structure 106 of the head portion 104 can be used to rotate, screw or unscrew the drain plug 100. It is appreciated that substantially any form of drive structure 106 can be used to rotate the drain plug 100. In an example, the drive structure 106 is a positive head. In another example, the drive structure 106 is a negative head. In yet another example, the drive structure 106 is a square head, flat head, hexagonal head, polygonal head, Phillips head, torque head, or Allen type head. In still yet another example, the drive structure 106 is a slot, square recess, hexagonal recess, or polygonal recess. In this example of FIG. 1, the drive structure 106 is a hexagonal head.

The annular groove 108 of substantially rectangular cross section receives the washer 110 of substantially rectangular cross section. In an example, the annular groove 108 of substantially rectangular cross section does not receive an O-ring. That is, the washer 110 is not an O-ring. In another example, the annular groove 108 of substantially rectangular cross section receives only a single washer 110 of substantially rectangular cross section.

Since the washer 110 has the substantially rectangular cross section, a surface of the substantially rectangular washer 110 comes in contact with the enclosure when the drain plug 100 is secured to the enclosure, thereby preventing and/or mitigating leaks of the contents of the enclosure. Also, since the substantially rectangular cross section shape of the washer 110 can be maintained in the annular groove 108 of substantially rectangular cross section while the drain plug 100 is secured to the enclosure, the washer 110 is not deformed by securing. When an O-ring washer is used in the annular grove 108 of substantially rectangular cross section, the O-ring may be deformed while secured, thereby causing leaks.

It is appreciated that the washer 110 contains substantially any suitable material to seal an opening of the enclosure. For example, the washer 110 may contain an elastic material such as a natural polymer or a synthetic polymer. Examples of the washer materials include diene rubbers such as natural rubber (NR), isoprene rubber (IR), butadiene rubber (BR), 1,2-butadiene rubber (1,2-BR), styrene-butadiene rubber (SBR), acrylonitrile-butadiene rubber (NBR), chloroprene rubber, butyl rubber (isobutylene-isoprene rubber IIR), and ethylene-propylene-diene rubber (EPDM) and those hydrogenated diene rubbers; olefin rubbers such as ethylene-propylene rubber (EPM), ethylene-butene rubber (EBM), chlorosulfonated polyethylene, ethylene-vinylacetate rubber (EVA), acrylic rubber (ACM), ethylene-Acrylic rubber (AEM), flourocarbon rubber, polyethylene rubber, and polypropylene rubber; epichlorohydrin rubber; polysulfide rubber; silicone rubber; urethane rubber; nitrile rubber; neoprene rubber; styrene rubber; and the like.

Examples of the washer materials also include thermoplastic elastomers. The thermoplastic elastomers are polymeric materials having both plastic and elastomeric properties. In an example, thermoplastic elastomers include thermoplastic polystyrene elastomer, thermoplastic polyolefin elastomer, thermoplastic poly (vinyl chloride) elastomer, thermoplastic polyester elastomer and the like. In another example, the thermoplastic elastomers include olefinic thermoplastic elastomers and chlorinated thermoplastic elastomers. In another example, the thermoplastic elastomers include chlorinated olefinic thermoplastic elastomers. General examples of olefinic thermoplastic elastomers, chlorinated thermoplastic elastomers, and chlorinated olefinic thermoplastic elastomers include polyolefines, polyvinylchloride-nitrile rubber blends such as polyvinylchloride-acrylonitrile-butadiene elastomer blends, polyvinylchloride-copolyester elastomer blends, polyvinylchloride-polyurethane elastomer blends, polychloroprenes, and chlorinated polyethylenes. Random, block, and graft copolymers of any of one or more thereabove also constitute thermoplastic elastomers in accordance with the present invention.

In an example, the washer 110 of substantially rectangular cross section protrudes partially from the annular groove 108. The washer 110 of substantially rectangular cross section may protrude partially from the annular groove 108 to seal an opening of the enclosure when the drain plug 100 is secured to a female-threaded opening of the enclosure. For example, the washer 110 of substantially rectangular cross section protrudes partially from the annular groove 108 to provide a liquid tight seal when an outer wall 112 of the annular groove 108 of the head portion 104 contacts the enclosure by securing the drain plug 100. In other words, the washer 110 of substantially rectangular cross section protrudes partially from the annular groove 108 to provide a secure seal between the upper surface of the substantially rectangular washer 110 and the enclosure and seal between an outer wall 112 of the annular groove 108 of the head portion 104 and the enclosure. The washer 110 is compressed when the drain plug 100 is secured to provide at least one of a seal and pressure against the drain plug 100.

It is appreciated that substantially any suitable length of the washer 110 may protrude from the annular groove 108 to provide seal when the drain plug 100 is secured to the enclosure. In an example, the washer 110 protrudes from the annular groove 108 from about 0.01 mm or more and about 5 mm or less. In another example, the washer 110 protrudes from the annular groove 108 from about 0.05 mm or more and about 2 mm or less. In an example, the washer 110 protrudes from the annular groove 108 from about 0.1 mm or more and about 1 mm or less.

An outer wall 112 of the annular groove 108 of the head portion 104 is positioned to contact the enclosure when the drain plug 100 is secured to a female-threaded opening of the enclosure. The contact/seal between the outer wall 112 of the annular groove 108 of the head portion 104 and the enclosure prevents and/or mitigates leaks of contents of the enclosure. When the enclosure contains metal, a metal-to-metal contact/seal between the outer wall 112 of the annular groove 108 of the head portion 104 and the metal enclosure prevents and/or mitigates leaks of contents of the enclosure. The outer wall 112 has a sufficient surface substantially parallel with the enclosure to achieve a torque seal.

The under-head surface 109 of the outer wall 112 of the drain plug 100 is positioned to contact an enclosure when the drain plug 100 is secured to a female-threaded opening of the enclosure. Metal to metal contact between the under-head surface 109 of the outer wall 112 and the enclosure provides a torque limiting feature, facilitating proper compression of a seal formed by the contact. The metal to metal contact also provides for a certain amount of compensation when the axis of the drain plug 100 is not perfectly parallel and concentric with the axis of the female-threaded opening of the enclosure.

The drain plug 100 may or may not contain a magnet 114 at an end of the male-threaded portion 102. The magnet 114 can be used to attract metals. For example, when the drain plug 100 is used in an automobile engine, the engine enclosure may contain small metal shavings and other debris due to the friction between a piston and a cylinder. The magnet 114 can be provided at the end of the male-threaded portion 102 to attract the metal shavings and/or particles in engine oil. When the drain plug 100 is removed to change the engine oil, the metal shavings and/or particles may be removed from the drain plug 100.

The male-threaded portion 102 may have a recess 118 at the end of the male-threaded portion 102. The recess 118 may be a substantially circular recess 118. In an example, a magnet 114 is secured in the recess 118 at the end of the male-threaded portion 102 by orbital forming 116 the end of the male-threaded portion 102. The end of the male-threaded portion 102 is deformed inwardly over the magnet 114 so that a lip of the end portion of the male-threaded portion 102 is formed tightly over the magnet 114 to attach the magnet 114 to the male-threaded portion 102.

Substantially any suitable orbital forming tools can be used to attach the magnet 114 to the male-threaded portion 102. The orbital forming tool may roll around on its edge in an orbital fashion, under pressure, to deform the material of the end portion of the male-threaded portion 102 over the magnet 114.

In another example, a magnet 114 is bonded to the bottom of the recess with a bonding agent such as an adhesive (not shown). The bonding agent may have heat resistance and oil resistance. In yet another example, the magnet 114 is attached to the end of the male-threaded portion 102 by crimping at several locations (not shown). In still yet another example, the magnet 114 is attached to the end of the male-threaded portion 102 by a screw (not shown).

The magnet 114 at the end of the male-threaded portion 102 may be rubber magnet or have a rubber coating. A rubber magnet 114 contains a resin and a magnetic powder. Examples of the resin include any material of washer described above. For example, the resins of the rubber magnet include an elastomeric material such as polyamide, polyolefin and an ethylenically copolymer. Examples of the magnetic powder include hard ferrite such as barium ferrite, strontium ferrite, an Nd—Fe—B type alloy, and a rare earth powder.

It is appreciated that substantially any suitable blending quantity of the magnetic power with the resin can provide suitable magnetic property of the resultant magnet. The quantity of the magnetic powder typically depends on the magnetic property required of the magnetic. In an example, the weight ratio of magnetic power/resin is about 0.6 or more and about 0.92 or less. In another example, the weight ratio of magnetic power/resin is about 0.7 or more and about 0.91 or less. In yet another example, the weight ratio of magnetic power/resin is about 0.8 or more and about 0.9 or less. In an example, the magnet has a magnet force of about 10 or more and 200 mT or less. The rubber magnet 114 may be sturdy and not easily broken because of the characteristics of resin when subjected to impact or to tensile or bending force.

The magnet 114 in a recess 118 at the end of the male-threaded portion 102 may or may not protrude from the end of the male-threaded portion 102. In an example, the outer surface of the magnet 114 in the recess 118 at the end of the male-threaded portion 102 is substantially coplanar with the end of the male-threaded portion 102. In another example, the outer surface of the magnet 114 in the recess 118 at the end of the male-threaded portion 102 sags below the end of the male-threaded portion 102.

The drain plug 100 contains substantially any suitable material that can be used to constitute a plug or bolt. For example, the drain plug 100 contains metal. Examples of the metal include one or more of steel, iron, brass, chrome, aluminum, copper, nickel, titanium, tin, magnesium, Hasetlloy®, Inconel®, a steel alloy, alloys thereof, and the like.

The drain plug 100 has substantially any suitable size as long as the drain plug 100 can be secured to a female-threaded opening of an enclosure. In an example, a length of the male-threaded portion 102 is about 5 mm or more and 50 mm or less, a diameter of the male-threaded portion 102 is about 5 mm or more and 50 mm or less, a length of the head portion 104 is about 2 mm or more and 30 mm or less, a diameter of the head portion 104 is about 10 mm or more and 100 mm or less, a size of the substantially rectangular cross section of the annular groove 108 is about 0.3 mm or more and 2 mm or less x about 1 mm or more and 10 mm or less. In another example, a length of the male-threaded portion 102 is about 10 mm or more and 40 mm or less, a diameter of the male-threaded portion 102 is about 10 mm or more and 40 mm or less, a length of the head portion 104 is about 3 mm or more and 20 mm or less, a diameter of the head portion 104 is about 15 mm or more and 90 mm or less, a size of the substantially rectangular cross section of the annular groove 108 is about 0.4 mm or more and 1.5 mm or less x about 2 mm or more and 8 mm or less. In yet another example, a length of the male-threaded portion 102 is about 12 mm or more and 30 mm or less, a diameter of the male-threaded portion 102 is about 12 mm or more and 30 mm or less, a length of the head portion 104 is about 4 mm or more and 10 mm or less, a diameter of the head portion 104 is about 16 mm or more and 80 mm or less, a size of the substantially rectangular cross section of the annular groove 108 is about 0.5 mm or more and 1 mm or less x about 3 mm or more and 7 mm or less.

In an example, the thickness of the washer 110 of substantially rectangular cross section is greater than the depth of the annular groove 108 of substantially rectangular cross section about 0.01 mm or more and about 5 mm or less. In another example, the thickness of the washer 110 of substantially rectangular cross section is greater than the depth of the annular groove 108 of substantially rectangular cross section about 0.05 mm or more and about 2 mm or less. In yet another example, the thickness of the washer 110 of substantially rectangular cross section is greater than the depth of the annular groove 108 of substantially rectangular cross section about 0.1 mm or more and about 1 mm or less.

Figure 2:
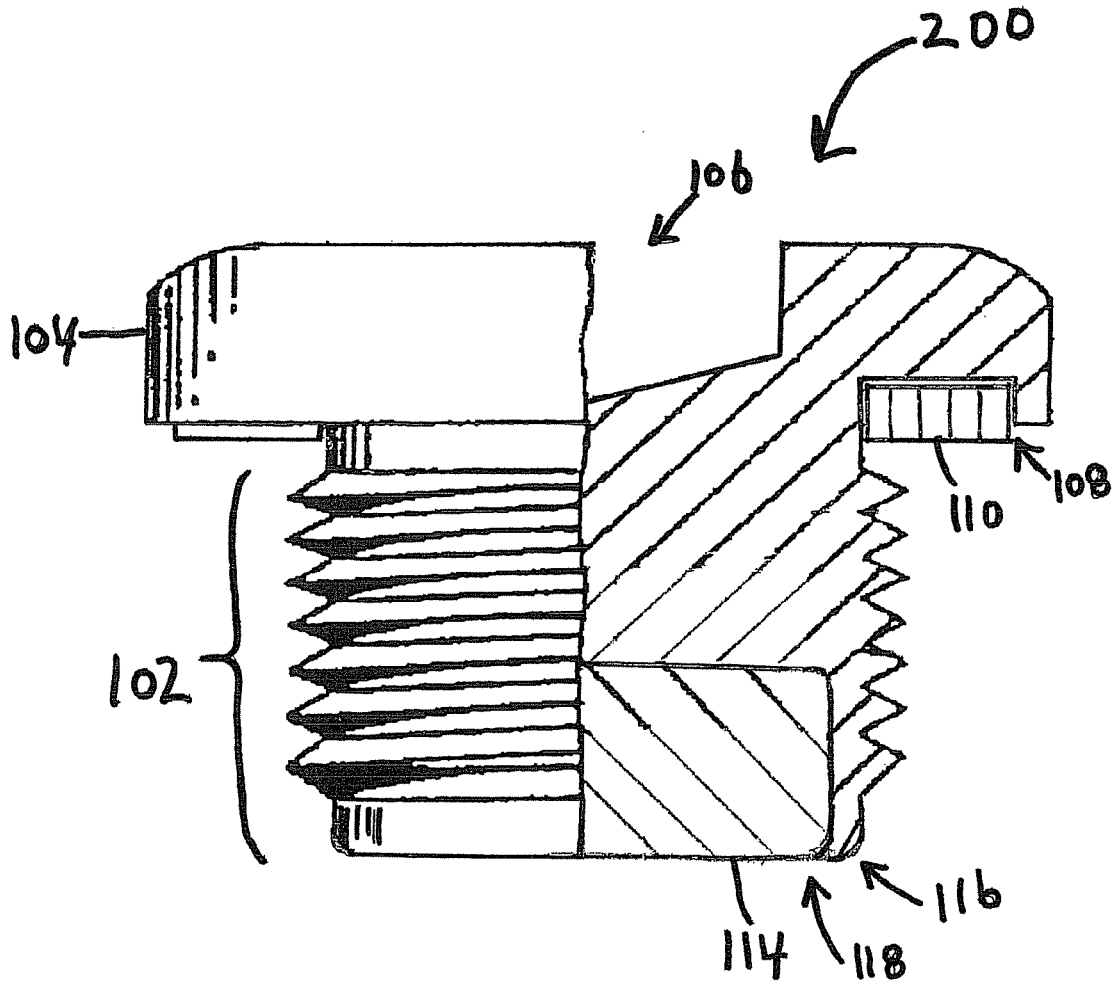
FIG. 2 illustrates a side view, partially cut away, of another exemplary drain plug in accordance with an aspect of the invention.

FIG. 2 illustrates another example of a drain plug 200 for an enclosure. The drain plug 200 contains a male-threaded portion 102 and a head portion 104. The head portion 104 contains a drive structure 106, an annular groove 108 of substantially rectangular cross section, and a washer 110 of substantially rectangular cross section in the groove 108. In this example, the drive structure 106 is a square recess.

The annular groove 108 of substantially rectangular cross section receives the washer 110 of substantially rectangular cross section. An outer wall 112 of the annular groove 108 of the head is positioned to contact the enclosure when the drain plug 100 is secured to a female-threaded opening of the enclosure. In this example, the drain plug 100 contains a rubber magnet 114 in a recess 118 at an end of the male-threaded portion 102. In this example of FIG. 2, the magnet 114 is secured in the recess 118 at the end of the male-threaded portion 102 by annularly crimping 116 the end of the male-threaded portion 102.

Figure 3:
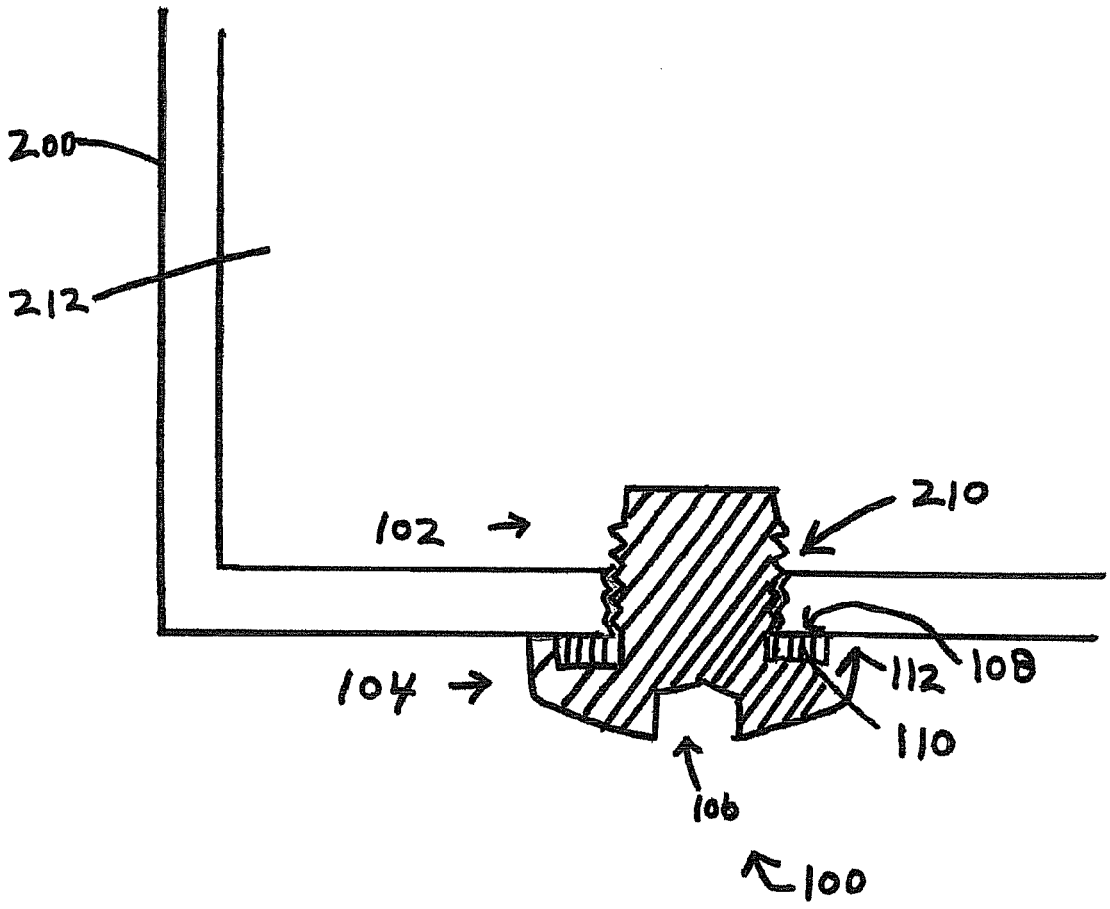
FIG. 3 illustrates a cross-sectional view of an exemplary enclosure and drain plug in accordance with an aspect of the invention.

FIG. 3 illustrates a cross-sectional view of an example enclosure 200 and an example drain plug 100 while the drain plug 100 is secured to a female-threaded opening 210 of the enclosure 200. The drain plug 100 contains a male-threaded portion 102 and a head portion 104. The head portion 104 contains a drive structure 106, an annular groove 108 of substantially rectangular cross section, and a washer 110 of substantially rectangular cross section in the groove 108.

Since the washer 110 has the substantially rectangular cross section, an upper surface of the substantially rectangular washer 110 comes in contact with the enclosure 200 when the drain plug 100 is secured to the female-threaded opening 210 of the enclosure 200, thereby preventing and/or mitigating leaks of the contents 212 of the enclosure 200. Also, since the substantially rectangular shape of the cross section of the washer 110 is maintained in the annular groove 108 of substantially rectangular cross section while the drain plug 100 is secured to the female-threaded opening 210 of the enclosure 200, the washer 110 is not deformed by securing. The drain plug 100 can be used to close the threaded fill or drain opening of any suitable enclosure. The washer 110 of substantially rectangular cross section can provide seal between the upper surface of the substantially rectangular washer 110 and the enclosure 200 when an outer wall 112 of the annular groove 108 of the head portion 104 contacts with the enclosure 200 by securing the drain plug 100.

The outer wall 112 of the annular groove 108 of the head portion 104 is positioned to contact the enclosure 200 when the drain plug 100 is secured to a female-threaded opening 210 of the enclosure 200. The contact/seal between the outer wall 112 of the annular groove 108 of the head portion 104 and the enclosure 200 prevents and/or mitigates leaks of contents 212 of the enclosure 200. When the enclosure 200 contains metal, a metal-to-metal contact/seal between the outer wall 112 of the annular groove 108 of the head portion 104 and the metal enclosure 200 prevents and/or mitigates leaks of contents 212 of the enclosure 200.

The washer 110 is surrounded by the enclosure 200 and the inner surface of the groove 108 while the drain plug 100 is secured to a female-threaded opening 210 of the enclosure 200 because the outer wall 112 of the annular groove 108 of the head comes in contact with the enclosure 200. Since the washer 110 is not exposed to road dirt and grit that may deform and/or abrade the washer 110, the washer 110 will not cause a leak.

The drain plug 100 may contain a magnet (not shown) in a recess at the end of the male-threaded portion 102 by annularly crimping the end of the male-threaded portion 102.

With respect to any figure or numerical range for a given characteristic, a figure or a parameter from one range may be combined with another figure or a parameter from a different range for the same characteristic to generate a numerical range.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A drain plug for an enclosure comprising a female-threaded opening, comprising:

a male-threaded portion;

a head portion comprising a drive structure and an annular groove formed on an under-head surface of the head portion and adjacent to the male-threaded portion wherein the groove has an inner boundary with a diameter less than an outer diameter of the male-threaded portion, the annular groove comprising a square cross section having a dimension of about 0.3 mm or more and 2.0 mm or less by about 1.0 mm or more and 10.0 mm or less, and an outer wall enclosing the annular groove;

a washer of a square cross section in the groove, wherein the washer does not comprise an O-ring washer and comprises an elastic material selected from a group consisting of diene rubber, olefin rubber, epichlorohydrin rubber, polysulfide rubber, silicone rubber, urethane rubber, and styrene rubber.

2. The drain plug of claim 1, wherein the washer protrudes partially from the annular groove from about 0.01 mm or more and about 5 mm or less.

3. The drain plug of claim 1 further comprising a magnet at an end of the male-threaded portion.

4. The drain plug of claim 3, the magnet comprises a rubber magnet or a rubber coating.

5. The drain plug of claim 3, the magnet does not protrude from the end of the male-threaded portion.

6. The drain plug of claim 3, the magnet is in a recess at the end of the male-threaded portion and the outer surface of the magnet is substantially coplanar with the end of the male-threaded portion.

7. The drain plug of claim 1, the drive structure is selected from a group consisting of a square head, flat head, hexagonal head, polygonal head, Phillips head, torque head, Allen type head, slot, square recess, hexagonal recess, and polygonal recess.

8. The drain plug of claim 1, wherein a surface of the outer wall is positioned to contact the enclosure when the drain plug is secured to the female-threaded opening.

9. The drain plug of claim 1, wherein the annular groove and the washer have square cross sections.

10. The drain plug of claim 1, wherein the square cross-section of the washer is maintained within the annular groove when the washer is compressed.

11. A drain plug for an enclosure comprising a female-threaded opening, comprising:

an annular groove of a square cross section having a dimension of about 0.3 mm or more and 2.0 mm or less by about 1.0 mm or more and 10.0 mm or less in an under-head surface portion of the drain plug and adjacent to a male-threaded portion wherein the groove has an inner boundary with a diameter less than an outer diameter of the male-threaded portion;

an outer wall enclosing the annular groove;

a washer of a square cross section in the annular groove, wherein the washer does not comprise an O-ring washer and comprises an elastic material selected from a group consisting of diene rubber, olefin rubber, epichlorohydrin rubber, polysulfide rubber, silicone rubber, urethane rubber, and styrene rubber; and an orbital forming an end of a male-threaded portion to hold a magnet at the end of the male-threaded portion.

12. The drain plug of claim 11, wherein the washer protrudes partially from the annular groove from about 0.01 mm or more and about 5 mm or less.

13. The drain plug of claim 11, wherein a surface of the outer wall is positioned to contact the enclosure when the drain plug is secured to the female-threaded opening.

14. The drain plug of claim 11, the drive structure is selected from a group consisting of a square head, flat head, hexagonal head, polygonal head, Phillips head, torque head, Allen type head, slot, square recess, hexagonal recess, and polygonal recess.

15. The drain plug of claim 11 further comprising a magnet at the end of the male-threaded portion.

16. The drain plug of claim 15, the magnet comprises a rubber magnet or a rubber coating.

17. The drain plug of claim 11, wherein the square cross-section of the washer is maintained within the annular groove when the washer is compressed.

* * * * *